United States Patent [19]

Murray

[11] Patent Number: 4,999,852

[45] Date of Patent: Mar. 19, 1991

[54] ARTICLE OF HEADWEAR

[76] Inventor: Charles W. Murray, 174 Thistledown Blvd., Rexdale, Ontario, Canada, M9V 1K1

[21] Appl. No.: 365,634

[22] Filed: Jun. 13, 1989

[30] Foreign Application Priority Data

Jun. 20, 1988 [CA] Canada ..... 569902

[51] Int. Cl.[5] ..... A42B 1/04

[52] U.S. Cl. ..... 2/196; 2/171.7; 2/195

[58] Field of Search ..... 2/171, 171.1, 171.2, 2/171.4, 171.5, 171.6, 171.7, 171.8, 172, 184.5, 195, 196, 209.1, 209.3, 12

[56] References Cited

U.S. PATENT DOCUMENTS

| | | | |
|---|---|---|---|
| 625,776 | 5/1899 | Klein | 2/195 |
| 1,105,400 | 7/1914 | Burke | 2/196 |
| 1,598,313 | 8/1926 | Rosenberg | 2/196 |
| 1,665,750 | 4/1928 | McKee | 2/171.7 |
| 2,116,076 | 5/1938 | Lipton | 2/171.5 |
| 2,774,256 | 5/1956 | Slotkin et al. | 2/195 |
| 4,277,847 | 7/1981 | Florio | 2/171 |
| 4,556,993 | 12/1985 | Okamura | 2/196 |
| 4,741,053 | 5/1988 | Okamura | 2/196 |

*Primary Examiner*—Werner H. Schroeder
*Assistant Examiner*—Diana L. Biefeld
*Attorney, Agent, or Firm*—Rogers, Bereskin & Parr

[57] ABSTRACT

According to the present invention there is provided an article of headwear, namely a hat, which has an opened position and a closed position. The hat has a forwardly projecting brim and a domed portion which extends rearwardly from the brim. The domed portion has a lower opening to accommodate a wearer's head therein. The domed portion includes a rear stationary portion and a foldable top portion. The foldable top portion is foldable downwardly and forwardly along first and second fold axes to form a top opening in the domed portion. In this manner, the article may assume the opened position. In a further embodiment, the foldable top portion may be releasably secured in the folded position, and in the unfolded or closed position may be releasably secured to the rear stationary portion.

15 Claims, 2 Drawing Sheets

FIG. 4
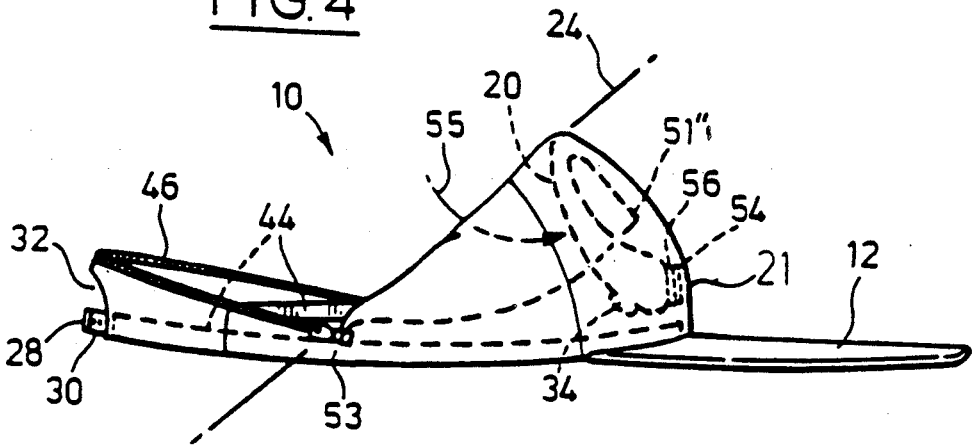
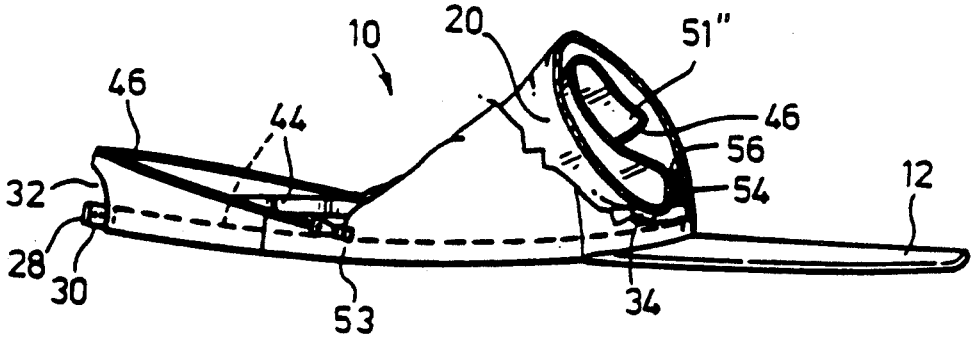
FIG. 5

ARTICLE OF HEADWEAR

FIELD OF THE INVENTION

This invention relates generally to the field of headwear, namely hats and the like, and in particular to the field of novelty headwear.

BACKGROUND OF THE INVENTION

Headwear, and in particular hats, have been known and used extensively for a variety of purposes. One such purpose is to shade the viewer's eyes from bright sunlight, when the wearer is engaged in some outdoor activity. Such hats typically have a large brim which protects the wearer's eyes by casting a shadow over the wearer's eyes. One common type of hat, is referred to as a baseball cap. Another common type of hat is referred to as visor. Typically, a baseball cap will have a domed portion extending back from the brim which covers the wearer's head to a substantial extent. In contrast, a visor will have an open topped portion and will attach to the wearer's head by means of, in essence, a headband and depending upon the weather conditions, such as the brightness of the sun, the temperature, rain or the like, either a visor, or a baseball cap is preferred.

BRIEF SUMMARY OF THE INVENTION

Accordingly, what is desired is an article of headwear which usefully incorporates the advantages of both the domed baseball cap and the visor. Therefore, according to the present invention, there is provided an article of headwear having an open position and a closed position, the article comprising: a forwardly projecting brim, and a domed portion extending rearwardly from the brim in the closed position, the domed portion having a lower opening for accommodating a wearer's head therein and a front generally adjacent said brim, the domed portion comprising a stationary portion and a foldable top portion, and in the open position at least a portion of the front remains unfolded and the foldable top portion is folded behind said front.

BRIEF DESCRIPTION OF THE DRAWINGS

A brief description of the drawings follows, which illustrate, by way of example, preferred embodiments of the invention, and in which:

FIG. 4 is a view of the invention of FIGS. 1 and 3 in a second folded position; and FIG. 5 is a view in part section of the invention of FIG. 4.

FIG. 1 shows a preferred embodiment of the instant invention. Indicated generally at 10 is an article of headwear, namely a hat, having a forwardly projecting brim 12 and a domed portion 14. The domed portion 14 extends rearwardly from the brim 12 and has a lower opening 16 for accommodating a wearer's head therein. The domed portion 14 is comprised of three elements, namely, a rear stationary portion 18, a foldable top portion 20 and a front 21. The front 21 rises generally upwardly from the brim, as shown in the figures. Also shown are a first fold axis 22 and second fold axis 24 which are explained in more detail below. As shown in dotted outline in FIG. 2, the brim 12 of the hat 10 is generally rectangular in shape with rounded corners 26. It will be appreciated by those skilled in the art that the particular shape of the brim 12 is not that important, providing that it covers sufficient area to cast a shadow over the wearer's eyes. The brim 12 may also be slightly rounded in cross section if desired. Also shown in FIG. 2 are a pair of straps 28 and 30 which may be adjusted to vary the size of the lower opening 16. In this manner a variety of different sized heads may be accommodated by one size of hat 10. To provide finger access to enable adjustment of the straps 28 and 30, an opening 32 is formed in the hat.

Figure 1:
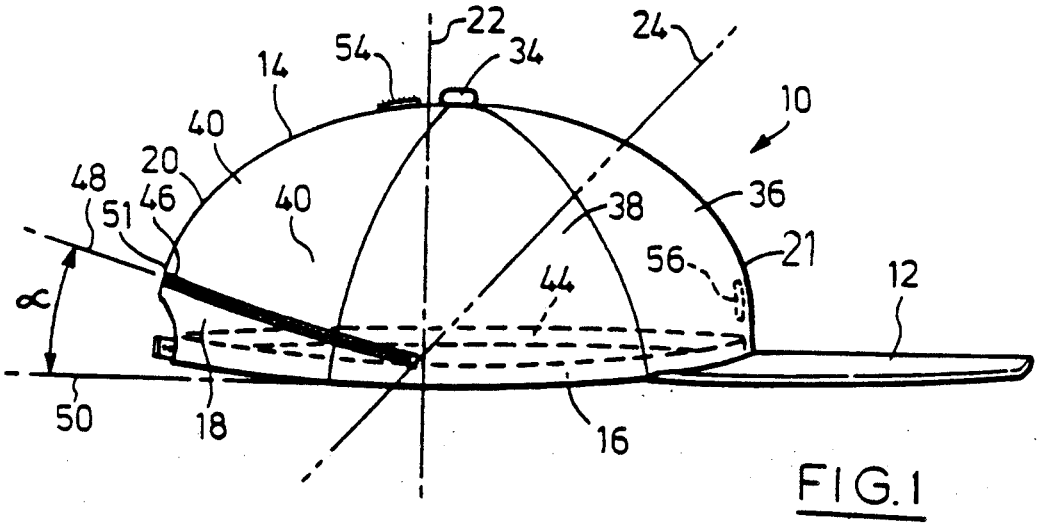
FIG. 1 is a side elevation view of a preferred embodiment of the present invention.

The hat may also be provided with a top button 34 for aesthetic reasons and the domed portion 14 would typically be formed from a number of panels. Panels 36, 38 and 40 are shown in FIGS. 1 and panel 42 appears in FIG. 2. The panels would be joined along their edges in any conventional manner such as by stitching, gluing or the like. In addition, the panels would be folded over at a lower edge to provide a stiffening seam around the inside portion of the lower opening 16. This seam is shown in dotted outline as 44.

Figure 2:
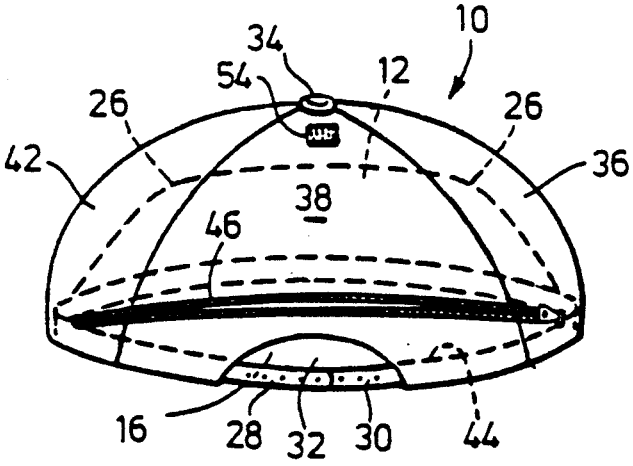
FIG. 2 is a rear elevation of the invention of FIG. 1.

FIG. 1 also shows a zipper 46 which releasably secures the rear stationary portion 18 to the top foldable portion 20. In FIG. 2, the zipper 46 is shown in the opened position. The zipper 46 extends along one side of the hat 10 around the back thereof above the opening 32 and then around to the other side of the hat 10. The zipper 46 is preferrably secured along a line formed from the intersection of a plane 48 with the domed portion 14. The plane 48 forms an angle $\alpha$ with horizontal, shown as line 50. Angle $\alpha$ is preferrably between 15° and 45°, although a preferred angle is 35°.

Figure 3:
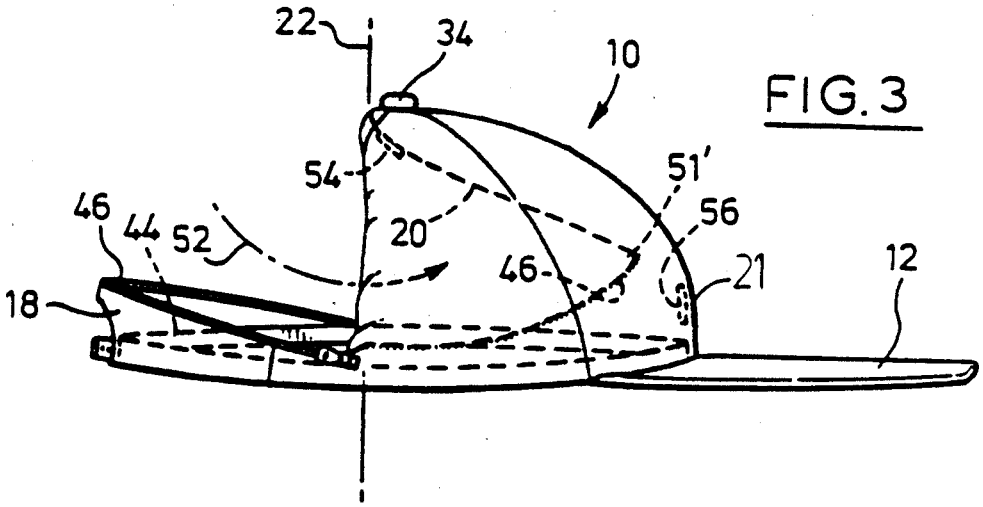
FIG. 3 is a view of the invention of FIG. 1 in a first folded position.

Turning now to FIG. 3 it may be appreciated how the present invention can be put into effect. FIG. 3 shows the foldable top portion 20 folded inwardly about first fold axis 22. The rearmost point of the hat 10 indicated as 51 in FIG. 1 is now shown as 51' in FIG. 3. The folding has taken place in the direction of arrow 52.

FIG. 4 shows the foldable top portion 20 in position after folding along the second fold axis 24. To arrive at the configuration of FIG. 4 from the configuration of FIG. 3, the foldable top portion 20 adjacent the top button 34 has been folded downwardly and forwardly in the direction of arrow 55 until the top button 34 is located in the position indicated in dotted outline in FIG. 4.

It will now be appreciated that the present invention relates to a hat 10 which may assume a baseball cap configuration, as shown in FIG. 1, or a visor configuration as shown in FIGS. 4 and 5. To assist the hat 10 remaining in an opened position as shown in FIGS. 4 and 5, a securing means is provided. Essentially, the securing means simply maintains the foldable top portion 20 in folded position as shown in FIGS. 4 and 5. In the preferred embodiment, the securing means comprises two co-operating patches of hook and loop pile fasteners, commonly known as velcro. A first patch is attached to outer surface of the domed portion 14 and is indicated as 54. A second patch is attached to the inside portion of the domed portion 14 and is indicated at 56. Upon folding the foldable top portion 20 about the second fold axis 24 the first patch 54 is brought into contact with second patch 56. In this manner, the hat 10 may be secured in the folded, open position. It will be appreciated by those skilled in the art that other forms of releasable fasteners may also be suitably used. For example, rather than the velcro patches, male and female snap fittings could be used, a button and button hole could be used, or other suitable, releasable attachment means could be used. FIG. 5 shows in cut-away section the folded foldable top section 20 and in particular the location of 51".

It will now be appreciated that the hat 10, in the fully folded position of FIGS. 4 and 5, is in essence a visor. The rear stationary portion 18 is joined at the sides 53 to folded foldable top portion 20. Thus, the rear stationary portion 18 forms in combination with the folded foldable top portion 20, a headband for attaching the brim 12 to a wearer's head, while at the same time, leaving the top open as may be desired by some wearers. It will be noted that in the open position, as shown in FIG. 4, the front 21 remains unfolded, and the foldable top portion 20 is neatly folded up behind the front 21. It will be appreciated that if the hat 10 carried a trade mark or logo on the front 21, in a known manner, the trade mark or logo would be visible in both the open and the closed positions. This visibility in the open position is due to the combination of the foldable top portion 20 being folded behind the front 21, and that the front 21 remains substantially unfolded.

Should the visor configuration of FIGS. 4 and 5 no longer be desired, for example in the case of rain, then the top foldable portion 20 may be unfolded, by following the steps indicated above in reverse order. Once in the fully unfolded position, as shown in FIG. 2, the zipper 46 can be used to releasably secure rear stationary portion 18 to foldable top portion 20 to completely close the hat 10.

It will be appreciated by those skilled in the art that many variations are possible within the broad scope of the present invention. Some of these have been suggested above and others would be apparent to those skilled in the art. For example, while reference has been made to releasably securing the rear stationary portion to the foldable top portion by means of a zipper 46, it will be appreciated that any suitable form of releasable fastener may be used.

I claim:

1. An article of headwear having an open position and a closed position, the article comprising:

a forwardly projecting brim, and a domed portion extending rearwardly from the brim in the closed position, the domed portion having a lower opening for accommodating a wearer's head therein and a front generally adjacent said brim, the domed portion comprising a stationary portion and a foldable top portion and in the open position, at least a portion of the front remains unfolded and the foldable top portion is folded behind said front, said foldable top portion being foldable inwardly along a first fold axis, and is further foldable inwardly along a second fold axis, said folded foldable top portion forming, with said stationary portion, a headband for the wearer's head, when said article is in said open position and wherein said front rises generally upwardly from said brim and a substantial portion of said front remains unfolded.

2. The article of headwear of claim 1 wherein said folded top portion is at least folded over to form at least a two-ply thickness.

3. The article of headwear of claim 1 wherein said folded top portion is at least twice folded over to form a fully open position.

4. The article of headwear of claims 1 wherein said stationary portion is located generally towards the rear of the article.

5. The article of headwear of claim 1 wherein said foldable top portion includes a first securing means on an outer surface, and a second securing means on an inner surface, said first and second securing means cooperating to releasably secure said foldable top portion in said folded position.

6. The article of headwear of claim 1, wherein said foldable top portion is releasably securable to said rear stationary portion.

7. An article of headwear having an open position and a closed position, the article comprising:

a forwardly projecting brim, and a domed portion extending rearwardly from the brim, the domed portion comprising a rear stationary portion, a foldable top portion, and a front rising generally upwardly from said brim, the foldable top portion being foldable inwardly, forwardly and downwardly along a first fold axis, and along a second fold axis, to assume a folded position behind said front, said article thereby assuming an open position, said domed portion including first and second securing means to releasably secure said foldable top portion in said open position, said rear stationary portion being releasably securable to said top foldable portion in said closed position and wherein said front of said domed portion remains unfolded, when said article is in said open position.

8. An article of headwear as claimed in claim 7 wherein said first and second securing means comprise cooperating hook and loop pile fasteners.

9. An article of headwear as claimed in claim 7 wherein said first and second securing means comprise male and female snap fittings.

10. An article of headwear as claimed in claim 7 wherein said first and second securing means comprise a cooperating button and buttonhole.

11. An article of headwear as claimed in claim 7 wherein said rear stationary portion is releasably securable to said foldable top portion by means of a zipper.

12. An article of headwear as claimed in claim 7 wherein said rear stationary portion is releasably securable to said foldable top portion by means of a hook and loop pile fastener.

13. An article of headwear as claimed in claim 7 wherein said stationary portion is releasably securable to said foldable top portion by at least one cooperating pair of male and female snap fittings.

14. An article of headwear as claimed in claims 1 or 7 wherein said stationary portion is releasably securable to said top foldable portion along a line of intersection between a plane and said domed portion, and where said plane forms an angle between 15° and 45° to a lower edge of said domed portion.

15. An article of headwear as claimed in claims 1 or 7, wherein said stationary portion is releasably securable to said top foldable portion along a line of intersection between a plane and said domed portion, and where said plane forms an angle about 35° to a lower edge of said domed portion.

* * * * *